US011105125B2

(12) United States Patent
Jung et al.

(10) Patent No.: US 11,105,125 B2
(45) Date of Patent: Aug. 31, 2021

(54) DOOR LOCKING ASSEMBLY

(71) Applicants: SoonDong Jung, Richmond Hill, GA (US); Austin G. Farmer, Savannah, GA (US); David J. Klapper, Bluffton, SC (US); Brad T. Windy, Rincon, GA (US)

(72) Inventors: SoonDong Jung, Richmond Hill, GA (US); Austin G. Farmer, Savannah, GA (US); David J. Klapper, Bluffton, SC (US); Brad T. Windy, Rincon, GA (US)

(73) Assignee: Great Dane LLC, Chicago, IL (US)

( * ) Notice: Subject to any disclaimer, the term of this patent is extended or adjusted under 35 U.S.C. 154(b) by 336 days.

(21) Appl. No.: 15/644,586

(22) Filed: Jul. 7, 2017

(65) Prior Publication Data

US 2019/0010739 A1 Jan. 10, 2019

(51) Int. Cl.

| | |
|---|---|
| ***E05B 83/10*** | (2014.01) |
| ***E05B 85/12*** | (2014.01) |
| ***E05B 63/24*** | (2006.01) |
| ***E05B 83/26*** | (2014.01) |

(52) U.S. Cl.

CPC ..... *E05B 83/10* (2013.01); *E05B 63/246* (2013.01); *E05B 83/26* (2013.01); *E05B 85/12* (2013.01)

(58) Field of Classification Search

CPC ..... E05B 83/10; E05B 83/08; E05B 83/00; E05B 83/02; E05B 83/06; E05B 83/12; E05B 83/04; E05B 63/246; E05B 63/242; E05B 63/244; E05B 83/26; E05B 85/12; E05B 85/10

USPC ..... 292/92

See application file for complete search history.

(56) References Cited

U.S. PATENT DOCUMENTS

| | | | | | |
|---|---|---|---|---|---|
| 1,023,164 | A | | 4/1912 | O'Connor | |
| 2,449,774 | A | * | 9/1948 | Haseltine | E05B 83/10 292/241 |
| 3,434,751 | A | * | 3/1969 | Chieger | E05B 83/10 292/218 |
| 3,549,185 | A | * | 12/1970 | Lynn | E05B 83/10 292/218 |
| 3,614,147 | A | * | 10/1971 | Spector | E05B 81/10 292/254 |
| 3,627,366 | A | | 12/1971 | Cerutti | |
| 4,057,273 | A | * | 11/1977 | Carr | E05B 83/10 292/218 |

(Continued)

OTHER PUBLICATIONS

Canadian Requisition dated Feb. 6, 2020, for corresponding Canadian application No. 3,010,181.

*Primary Examiner* — Nathan Cumar

(74) *Attorney, Agent, or Firm* — Nelson Mullins Riley & Scarborough LLP

(57) ABSTRACT

A trailer locking assembly for locking a door of a trailer includes a lock rod pivoting about its axis of elongation within an upper and a lower bracket. A top and bottom cam attach to the top and bottom of the lock rod, respectively, and the top and bottom cams are configured to engage with corresponding keepers. A handle attached to the bottom cam beneath the door is configured to engage with a first latch assembly. The latch assembly may be configured to be released from an interior of the trailer. The first latch assembly may be attached to the lower bracket. The locking assembly may have a second latch assembly for holding the door open.

21 Claims, 14 Drawing Sheets

(56) References Cited

U.S. PATENT DOCUMENTS

| | | | | |
|---|---|---|---|---|
| 8,231,150 | B2 | 7/2012 | Ehrlich et al. | |
| 2019/0010739 | A1* | 1/2019 | Jung | E05B 83/10 |

* cited by examiner

DOOR LOCKING ASSEMBLY

FIELD OF THE INVENTION

Example embodiments generally relate to cargo carrying trailers and, in particular, to door locking assemblies for use with cargo carrying trailers.

BACKGROUND OF THE INVENTION

A wide variety of trailers are known for carrying cargo. For example, van type trailers typically include a deck assembly supported by a side wall structure, wheels, and front legs. The deck assembly typically includes longitudinal floor boards and transverse cross-members, such as I-beams, extending between opposing bottom rails. The deck transfers its load to the bottom rails, wheels, and, depending upon whether or not the trailer is coupled to a tractor or is free-standing, to a tractor fifth wheel or to retractable front legs on the trailer. A pair of doors, disposed at the rear of the trailer, open to provide access to the trailer's cargo space.

The doors pivot on hinges about axes at rear vertical edges of the trailer's frame. The doors may be closed and locked. Typically, an elongated lock rod pivots about its axis within a bearing disposed at a top, and a bearing disposed at a bottom, of each door. A handle attached to the lock rod above the bottom of each door provides leverage for enabling an operator to pivot each lock rod about its axis. To lock the doors, the operator pivots each of the handles to a locked position wherein each of the handles extends, in its direction of elongation, towards its respective nearest side of the trailer. When each of the handles is oriented in the locked position, a top cam and a bottom cam, both attached to the lock rod, extend into, and engage with, keepers attached to the rear frame above and below the corresponding door, respectively, so that opening of the door about its respective hinges is prevented. When the operator pivots the lock rod via the handle in the opposite direction, the cams disengage from the keepers, and the door may be opened. When each of the handles is in its locked position, it may be held in place by a latch that attaches to the door at a location spaced from bearing brackets, which hold the bearings (in which each of the lock rods pivots) to the door. The latch may receive a hasp of a lock to further secure the door in its locked position.

When the doors are unlatched, they may pivot approximately 270 degrees about their hinges so that the doors are almost parallel to the trailer's sides. Hooks attached to chains attached to the doors hook through keepers on the sides of the semi-trailer in order to hold the doors open and generally against the sides of the trailer, and bumpers bias the doors away from the sides to keep tension on the chains.

As will be apparent, embodiments of the present disclosure overcome shortcomings of the prior art.

SUMMARY OF THE INVENTION

Some example embodiments enable the provision of a door locking assembly. According to an example embodiment, a locking assembly is adapted for use with a semi-trailer including two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The locking assembly includes an elongated lock rod having an axis of elongation. At least one bracket attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod when the first door is in a closed position on the rear frame at which the first door closes an opening to the interior, the first member latch engages the first keeper so that the lock rod retains the first door in the closed position. In a second rotational position of the lock rod rotationally offset from the first rotational position, the first latch member disengages from the first keeper so that the first door is pivotable from the closed position. A second latch member attaches to the lock rod so that rotation of the second latch member about the axis of elongation rotates the lock rod about the axis of elongation. A second keeper is attached to the first door by a handle that extends through the first door into the interior. When the second keeper is retained to the door by the handle and a portion of the second keeper extends into a retainer attached to the door, the second latch member is receivable by the second keeper so that the second keeper retains the second latch member adjacent to the first door. The second latch member is connected to the lock rod at a position so that when the second latch member is received by the second keeper, the lock rod is in the first rotational position. The handle is attached to the second keeper at a connection that is releasable by actuation of the handle from within the interior when the first door is in the closed position, thereby releasing the second keeper from the handle so that the portion of the second keeper is releasable from the retainer in response to movement of the first door by a force applied from the interior by a pivoting of the second keeper about an engagement between the portion of the second keeper and the retainer.

In another example embodiment, a semi-trailer includes two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The semi-trailer further includes a door locking assembly including an elongated lock rod having an axis of elongation. At least one bracket attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod when the first door is in a closed position on the rear frame at which the first door closes an opening to the interior, the first member latch engages the first keeper so that the lock rod retains the first door in the closed position. In a second rotational position of the lock rod rotationally offset from the first rotational position, the first latch member disengages from the first keeper so that the first door is pivotable from the closed position. A second latch member attaches to the lock rod so that rotation of the second latch member about the axis of elongation rotates the lock rod about the axis of elongation. A second keeper is attached to the first door by a handle that extends through the first door into the interior. When the second keeper is retained to the door by the handle and a portion of the second keeper extends into a retainer attached to the door, the second latch member is receivable by the second keeper so that the second keeper retains the second latch member adjacent to the first door. The second latch member is connected to the lock rod at a position so that when the second latch member is received by the second keeper, the lock rod is in the first rotational position. The handle is attached to the second keeper at a connection that is releasable by actuation of the handle from within the interior when the first door is in the closed position, thereby releasing the second keeper from the handle so that the portion of the second keeper is releasable from the retainer in response to movement of the first door by a force applied from the interior by a pivoting of the second keeper about an engagement between the portion of the second keeper and the retainer.

According to an example embodiment, a locking assembly is adapted for use with a semi-trailer including two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The locking assembly includes an elongated lock rod having an axis of elongation. At least one bracket, attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod when the first door is in a closed position on the rear frame at which the first door closes an opening to the interior, the first latch member engages the first keeper so that the lock rod retains the first door in the closed position. In a second rotational position of the lock rod rotationally offset from the first rotational position, the first latch member disengages from the first keeper so that the first door is pivotable from the closed position to an open position in which the first door is adjacent an outer surface of one of the two side walls. A handle attaches to the lock rod so that rotation of the handle about the axis of elongation rotates the lock rod about the axis of elongation. The handle has a first end pivotally attached to the lock rod about a horizontal axis so that the handle is pivotable with respect to the lock rod in a vertical direction. A second latch member attaches to the handle at the horizontal axis so that the second latch member rotates with the handle and about the horizontal axis. A second keeper is disposed at a bottom rail to which the one side wall and the floor attach and that is disposed on the bottom rail so that the second keeper receives the second latch when the handle is disposed at a first rotational position about the horizontal axis and that retains the second latch member, and therefore retains the first door adjacent the one side wall, when the handle is disposed at a second rotational position.

In yet another example embodiment, a semi-trailer includes two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The semi-trailer further includes a door locking assembly including an elongated lock rod having an axis of elongation. At least one bracket, attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod when the first door is in a closed position on the rear frame at which the first door closes an opening to the interior, the first latch member engages the first keeper so that the lock rod retains the first door in the closed position. In a second rotational position of the lock rod rotationally offset from the first rotational position, the first latch member disengages from the first keeper so that the first door is pivotable from the closed position to an open position in which the first door is adjacent an outer surface of one of the two side walls. A handle attaches to the lock rod so that rotation of the handle about the axis of elongation rotates the lock rod about the axis of elongation. The handle has a first end pivotally attached to the lock rod about a horizontal axis so that the handle is pivotable with respect to the lock rod in a vertical direction. A second latch member attaches to the handle at the horizontal axis so that the second latch member rotates with the handle and about the horizontal axis. A second keeper is disposed at a bottom rail to which the one side wall and the floor attach and that is disposed on the bottom rail so that the second keeper receives the second latch when the handle is disposed at a first rotational position about the horizontal axis and that retains the second latch member, and therefore retains the first door adjacent the one side wall, when the handle is disposed at a second rotational position.

In still another example embodiment, a locking assembly is adapted for use with a semi-trailer including two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The locking assembly includes an elongated lock rod having an axis of elongation. At least one bracket attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod, when the first door is in a closed position on the rear frame at which the first door closes an opening to the interior, the first latch member engages the first keeper so that the lock rod retains the first door in the closed position, and in a second rotational position of the lock rod rotationally offset from the first rotational position, the first latch member disengages from the first keeper so that the first door is pivotable from the closed position. A second latch member attaches to the lock rod so that rotation of the second latch member about the axis of elongation rotates the lock rod about the axis of elongation. A second keeper is attached to the at least one bracket. The second end of the second latch member is receivable into the second keeper so that the second keeper retains the second latch member adjacent to the door. The second latch member is connected to the lock rod at a position so that when the second latch member is received by the second keeper, the lock rod is in the first rotational position.

In yet another example embodiment, a semi-trailer includes two opposing elongated side walls, a floor extending between respective lower ends of the two side walls, a roof extending between respective upper ends of the two side walls, a front wall extending between respective forward ends of the two side walls and between respective forward ends of the floor and the roof, a rear frame attached to respective rearward ends of the two side walls, a rearward end of the roof, and a rearward end of the floor, and a pair of doors attached to the rear frame. The two side walls, the floor, the roof, and the front wall define an interior of the semi-trailer, and a first of the doors pivotally attach at an edge of the first door to a vertical portion of the rear frame at one of the two side walls, and a second of the doors pivotally attaches at an edge of the second door to a vertical portion of the rear frame at the other of the two side walls. The semi-trailer further includes a door locking assembly including an elongated lock rod having an axis of elongation. At least one bracket attaches to the first door and extends about the lock rod so that the lock rod is retained proximate the first door in a vertical orientation and so that the lock rod is rotatable about the axis of elongation. A first keeper attaches to the rear frame of the semi-trailer. A first latch member attaches to the lock rod so that the first latch member rotates with the lock rod. In a first rotational position of the lock rod, when the first door is in a closed position on the rear frame at which the first door closes an opening to the interior, the first latch member engages the first keeper so that the lock rod retains the first door in the closed position, and in a second rotational position of the lock rod rotationally offset from the first rotational position, the first latch member disengages from the first keeper so that the first door is pivotable from the closed position. A second latch member attaches to the lock rod so that rotation of the second latch member about the axis of elongation rotates the lock rod about the axis of elongation. A second keeper is attached to the at least one bracket. The second end of the second latch member is receivable into the second keeper so that the second keeper retains the second latch member adjacent to the door. The second latch member is connected to the lock rod at a position so that when the second latch member is received by the second keeper, the lock rod is in the first rotational position.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
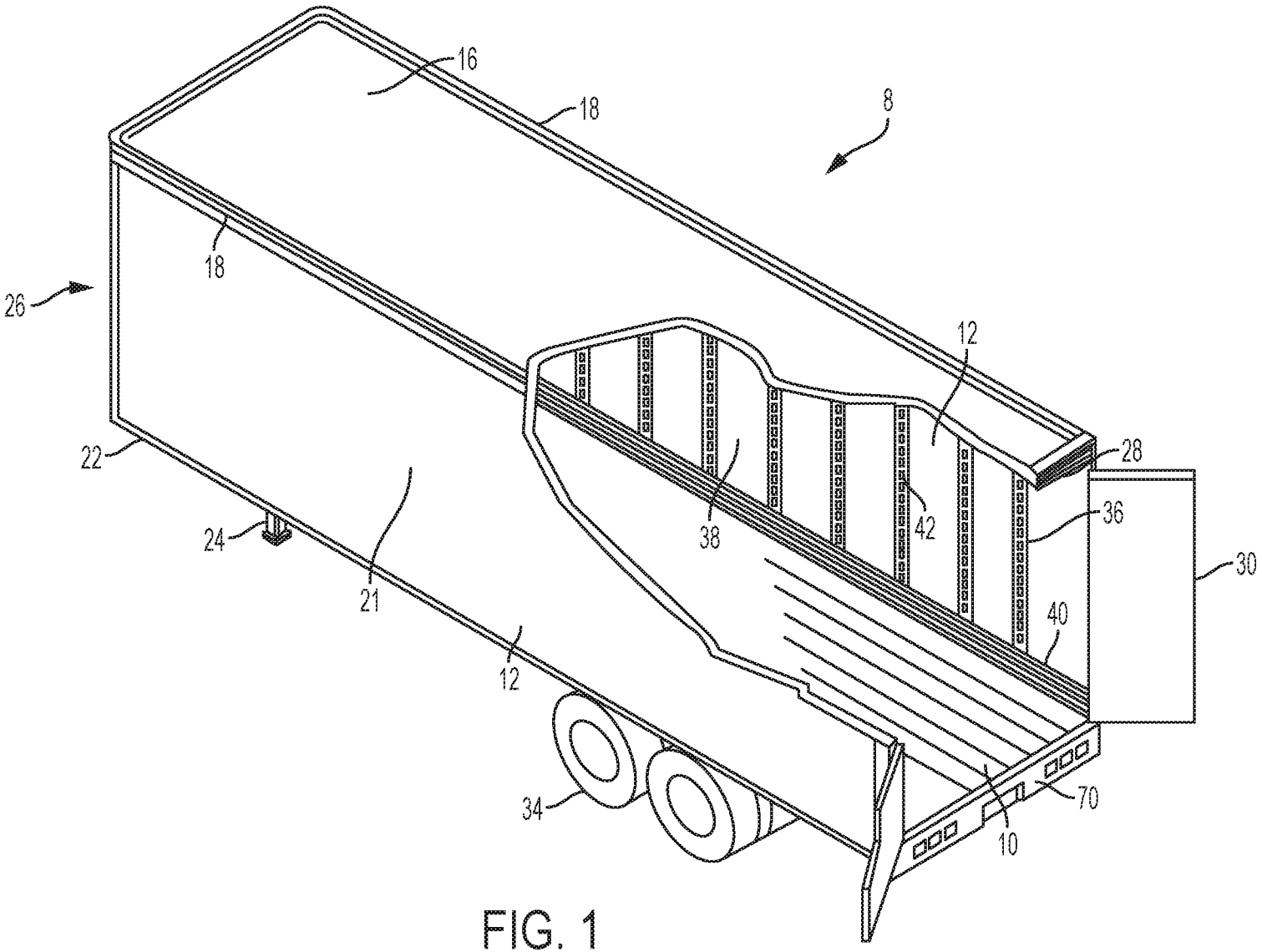
FIG. 1 is a perspective view of a semi-trailer in accordance with embodiments of the present disclosure.

Repeat use of reference characters in the present specification and drawings is intended to represent same or analogous features or elements of the invention according to the disclosure.

DESCRIPTION OF THE PREFERRED EMBODIMENTS

Some example embodiments now will be described more fully hereinafter with reference to the accompanying drawings, in which some, but not all, example embodiments are shown. Indeed, the examples described and pictured herein should not be construed as being limiting as to the scope, applicability, or configuration of the present disclosure. Like reference numerals refer to like elements throughout. As used herein, "operable coupling" should be understood to relate to direct or indirect connection that, in either case, enables functional interconnection of components that are operably coupled to each other.

As used herein, terms referring to a direction or a position relative to the orientation of a semi-trailer, such as but not limited to "vertical," "horizontal," "above," or "below," refer to directions and relative positions with respect to semi-trailer's orientation in its normal intended operation, as indicated in FIG. 1. Further, "right side" and "left side" are defined from the perspective of one facing in the trailer's longitudinal direction and towards a front of the trailer at which a tractor may attach.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

FIG. 1 illustrates a semi-trailer 8 having a floor 10, two side walls 12, and a roof 16. The side walls 12 are identically constructed, though mirror images of each other. Roof 16 is attached to side walls 12 by top rails 18, and each side wall is connected to floor 10 by a bottom rail 22 (one of which is shown in FIG. 1). The trailer includes retractable legs 24, a forward end wall 26 (not shown), and a rearward end frame 28 that includes a rear sill 70. Once assembled, the roof, floor, and side walls form a trailer having a generally rectangular cross-section when viewed from the rear and define a cargo space. The distance between inner surfaces of each side wall 12 is generally greater than 90 inches, and the distance between outer surfaces of each side wall 12 is generally less than 110 inches. A plurality of wheels 34 on a plurality of axles support the trailer's rearward end and facilitate movement of the trailer when coupled to a tractor (not shown). A front end of the semi-trailer includes a kingpin (not shown) that is configured to engage the trailer with a fifth wheel (not shown) of the tractor. The fifth wheel includes a flat plate that is typically greased so that a lower surface of the trailer slides against an upper surface of the fifth wheel. A fifth wheel coupling enables the trailer to pivot in the horizontal plane with respect to the tractor.

Figure 2:
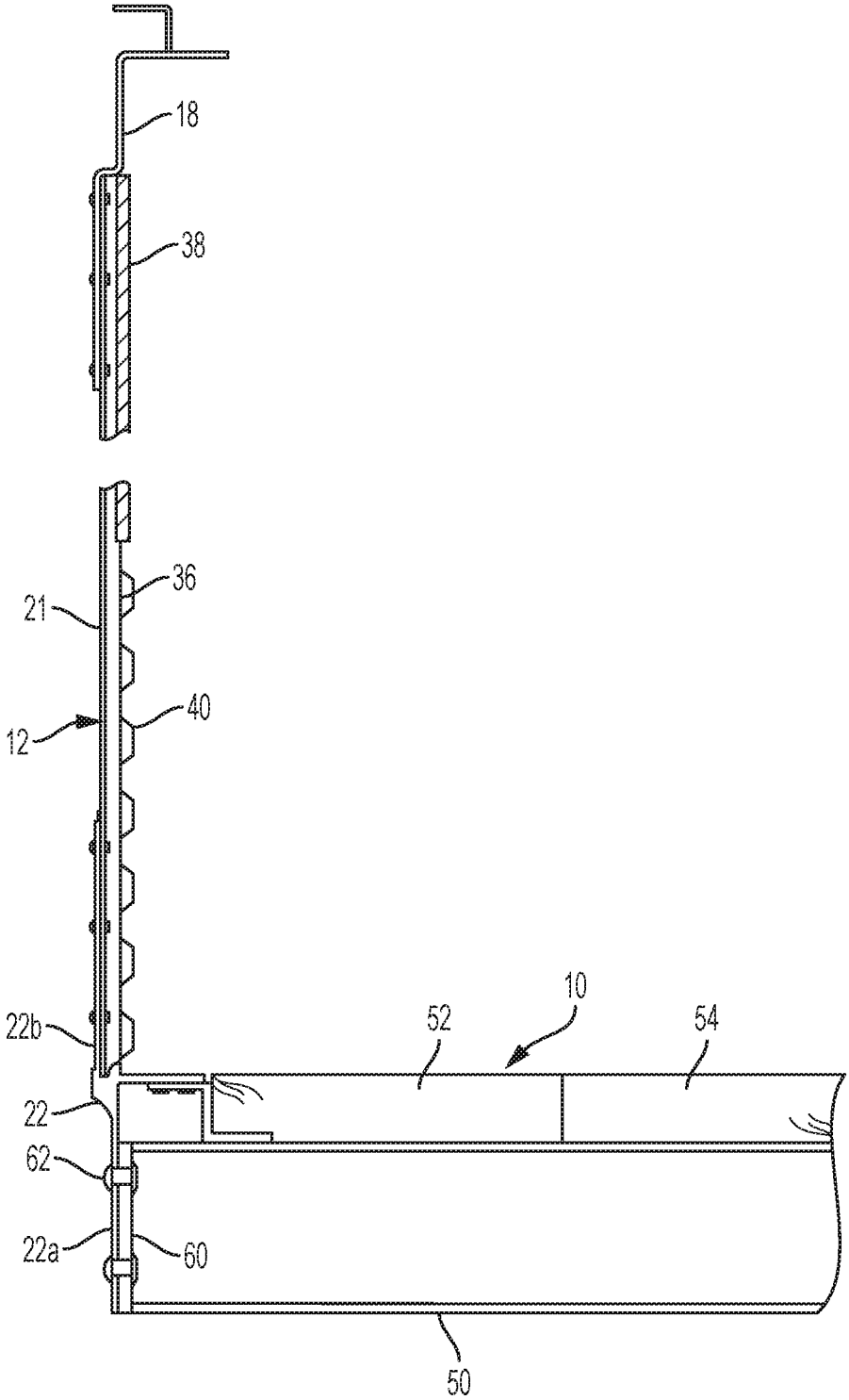
FIG. 2 is partial section view of the semi-trailer of FIG. 1.

Referring also to FIG. 2, side wall 12 includes a plurality of vertical posts 36, a plurality of interior side wall liner panels 38, and one or more scuff bands 40. The liner panels interconnect the posts, and the scuff band is received within a recessed portion of a bottom portion of posts 36. Each post includes a longitudinal front face through which is defined a series of apertures 42 for receipt of cargo straps and the like to secure the trailer contents.

Panels 38 are fastened to posts 36 by screws, rivets, tapit pins, or any other suitable method. The panels are constructed of plywood or other suitable materials, for example steel. In an embodiment, the panels comprise corrugated metal panels including a plurality of recessed channels that give the panels added structural strength and stiffness.

Posts 36 are fastened to top rail 18 by suitable means such as rivets, screws or the like. Thus, the panels are secured to the top rail though their connections to the posts. An outer skin 21 is fastened to the trailer's top and bottom rails. The portion of the top rail to which the posts are fastened extends behind liner panels 38. It should be understood that this form of trailer construction is provided for purposes of example only and that other types of trailers may be utilized, e.g. constructions of plate-type or other trailers.

Figure 3:
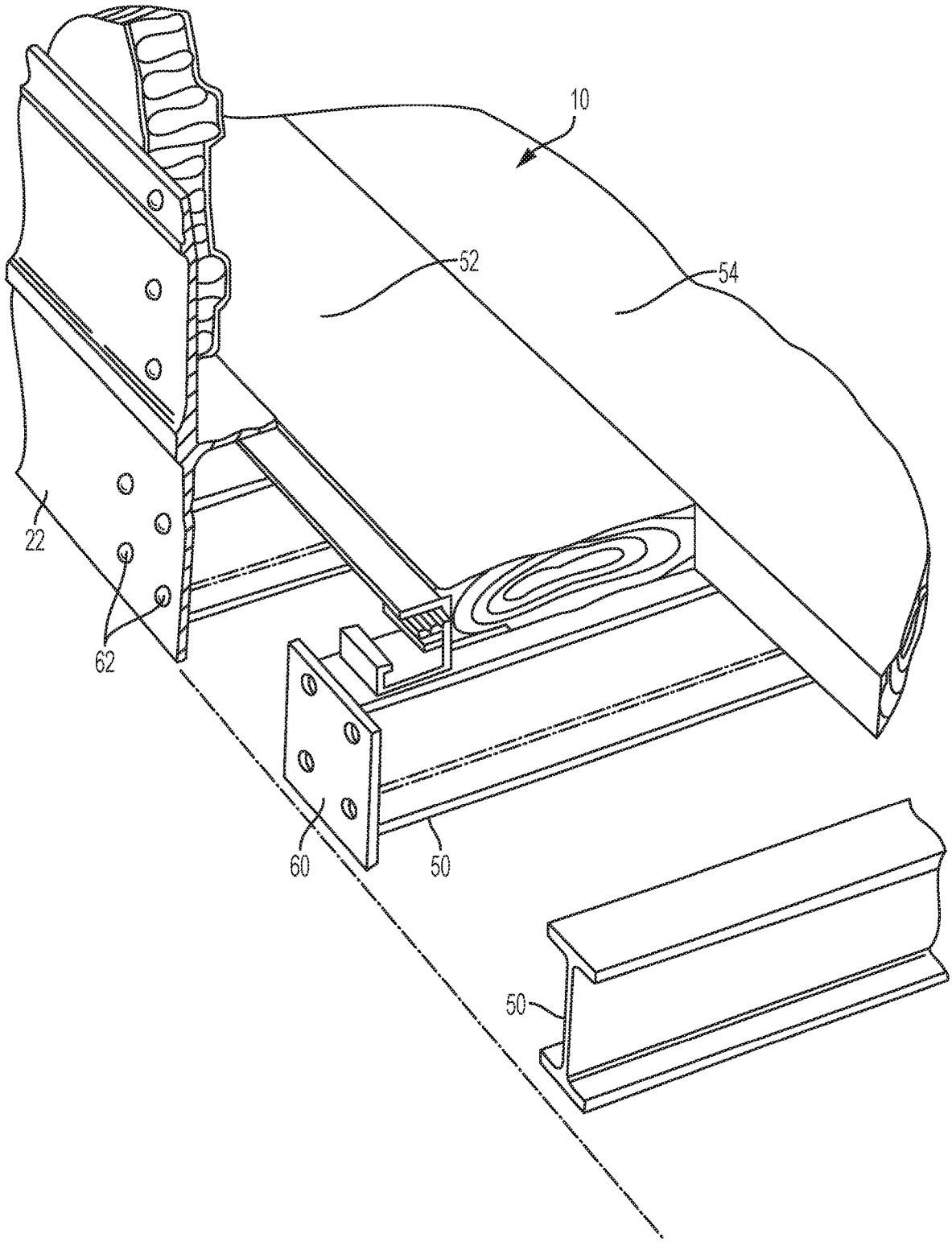
FIG. 3 is a partial perspective view of a cut-away of the semi-trailer of FIG. 1.

As best seen in FIG. 3, the deck assembly includes a floor 10 and I-beam support members, also referred to as I-beams or cross-members, 50 that extend transverse to the longitudinal direction of the trailer and that are connected on both ends to trailer bottom rails 22 (one of which is shown in FIG. 3). The floor comprises a series of parallel longitudinal floorboards including an edge plank 52 and inner planks 54 extending side-by-side across the trailer and secured to I-beam support members 50 by bolts or other materials and methods as should be understood in the art. Each I-beam 50 includes an end plate 60 welded to each end, and end plates 60 are fastened to a bottom portion of bottom rail 22 via, for example, rivets 62. The axles are attached to the beams so that the floor transfers its load to the axles and the wheels. Axles are attached to the trailer through a suspension system, e.g., an air ride suspension or leaf springs. The suspension is attached to a subframe that attaches to cross members or to longitudinal rails that, in turn, attach to the cross members.

Referring to FIG. 1, a pair of doors 30 at the trailer's rearward end are pivotally connected to vertical sides of rear end frame 28 via hinges. Typically, four or five hinges attach each door. A typical hinge includes a pair of aluminum extrusion hinge butts. A first hinge butt is welded to the sides of the rear frame, a second attaches to each door via attachment hardware (e.g., screws, or rivets), and a pin extends through loops in the hinge butts to hold the first butt in a pivotable relationship with the second hinge butt. Each door 30 extends halfway across the trailer's rear opening so that the edges of the closed doors opposite the hinges meet in the middle of the rear opening to oppose each other. A gasket comprising outward-extending flaps extends along the edges of each door to provide a generally water-tight seal between the trailer doors and the rear frame as well as between the doors when the doors are closed.

In the illustrated embodiment, many components of the locking assembly for the right side door (from a perspective behind the trailer, facing the doors in the direction toward the front of the vehicle) are the same as the components of the locking assembly of the left side door, mirrored about a vertical plane extending longitudinally through the middle of the trailer. Therefore, while references to components below describe the locking assembly for the right side door, it should be understood that corresponding left side components are identical but mirrored across a vertical plane.

In an embodiment, the locking assembly includes a lock rod having an axis of elongation that pivotably attaches to a door. A first latch member that is rotationally fixed with respect to the lock rod (so that rotation of the lock rod causes corresponding rotation to the first latch member) attaches to an end of the lock rod and engages with a first keeper that is attached to the rear frame of the trailer so that opening of the door is prevented. A second latch member attaches to the lock rod so that rotation of the lock rod about the lock rod's axis causes the second latch member to pivot about the lock rod's axis of rotation. The second latch member is engageable with a second keeper that attaches to the door and is configured to retain the second latch member so that the second latch member cannot pivot about the lock rod's axis, thereby preventing the lock rod from pivoting and thus the first latch member from releasing from the first keeper. In an embodiment, the first latch member is a cam, and the second latch member is a handle that attaches to the cam, thereby indirectly attaching the handle to the lock rod.

Figure 4:
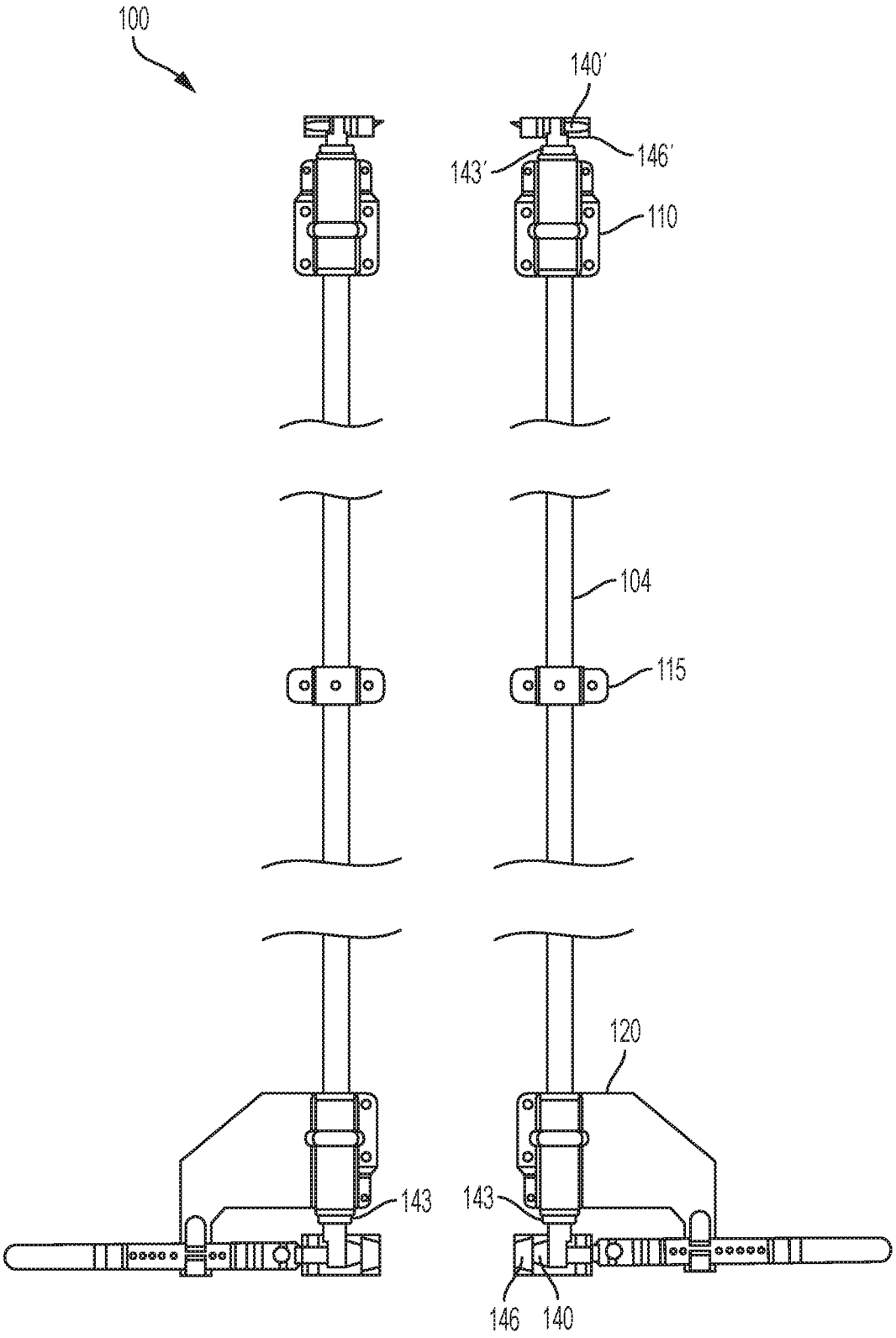
FIG. 4 is a rear view of a locking assembly for use on the semi-trailer of FIG. 1.
Figure 5:
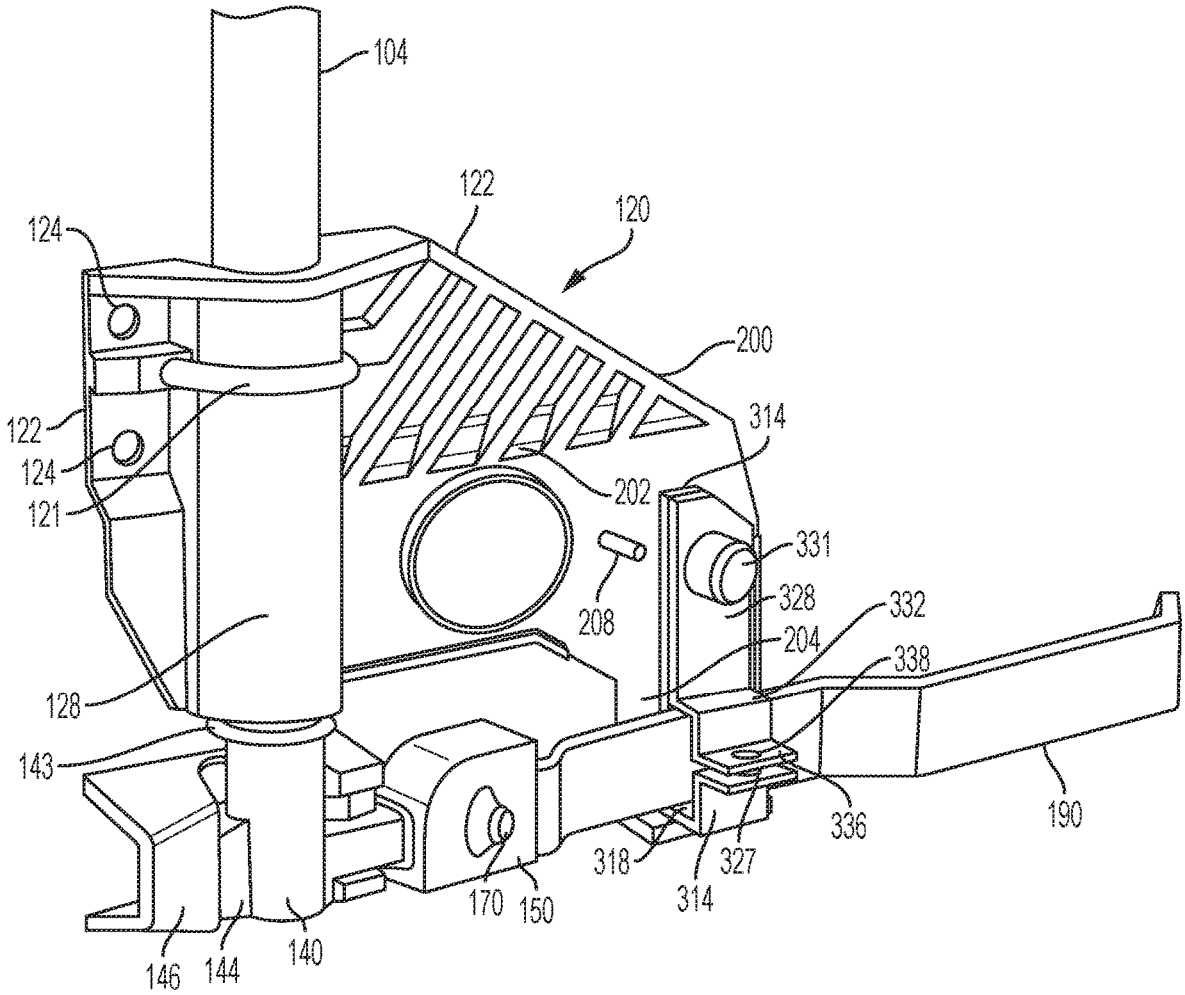
FIG. 5 is a partial perspective rear view of the locking assembly of FIG. 4.
Figure 6:
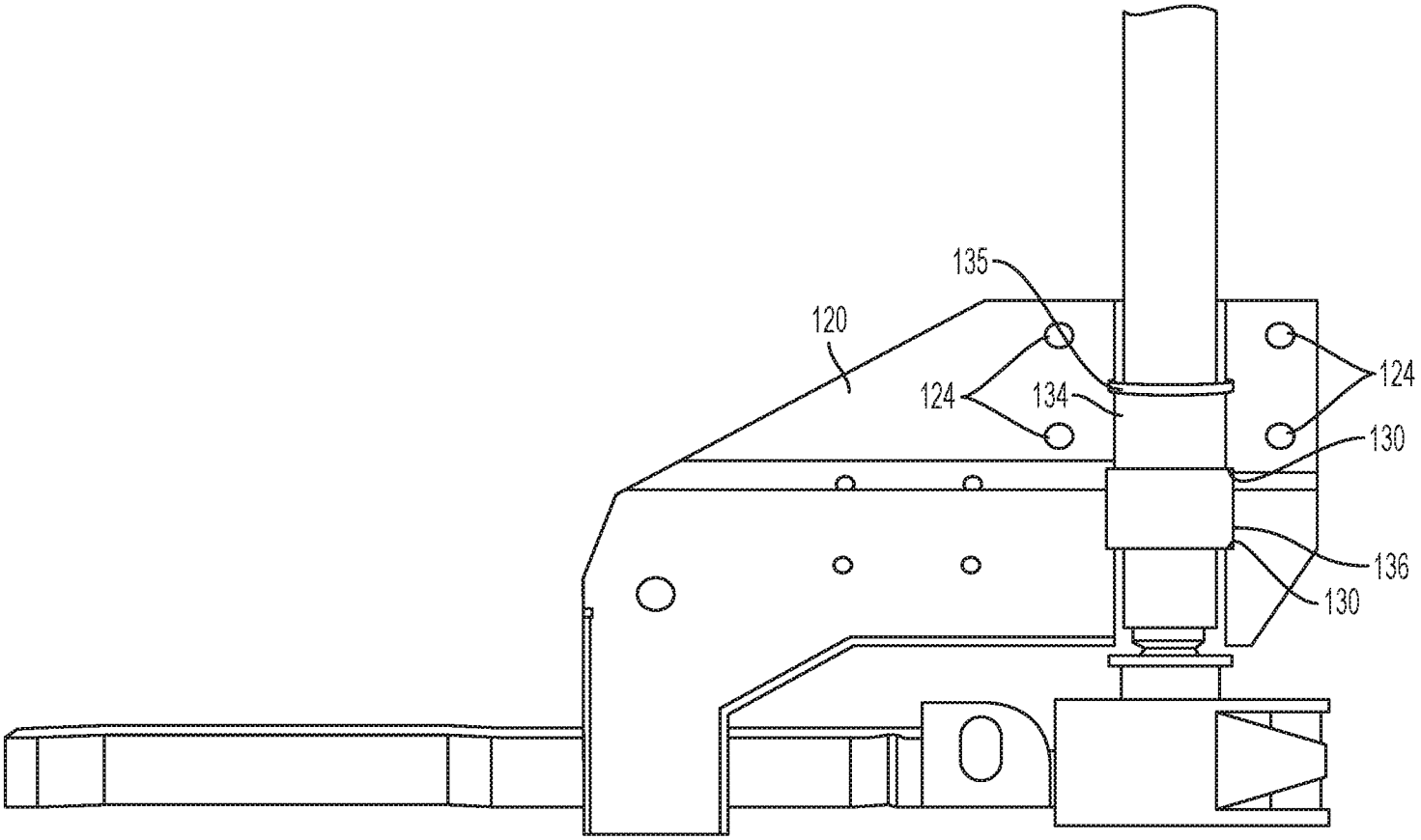
FIG. 6 is a front view of the locking assembly of FIG. 4.
Figure 11:
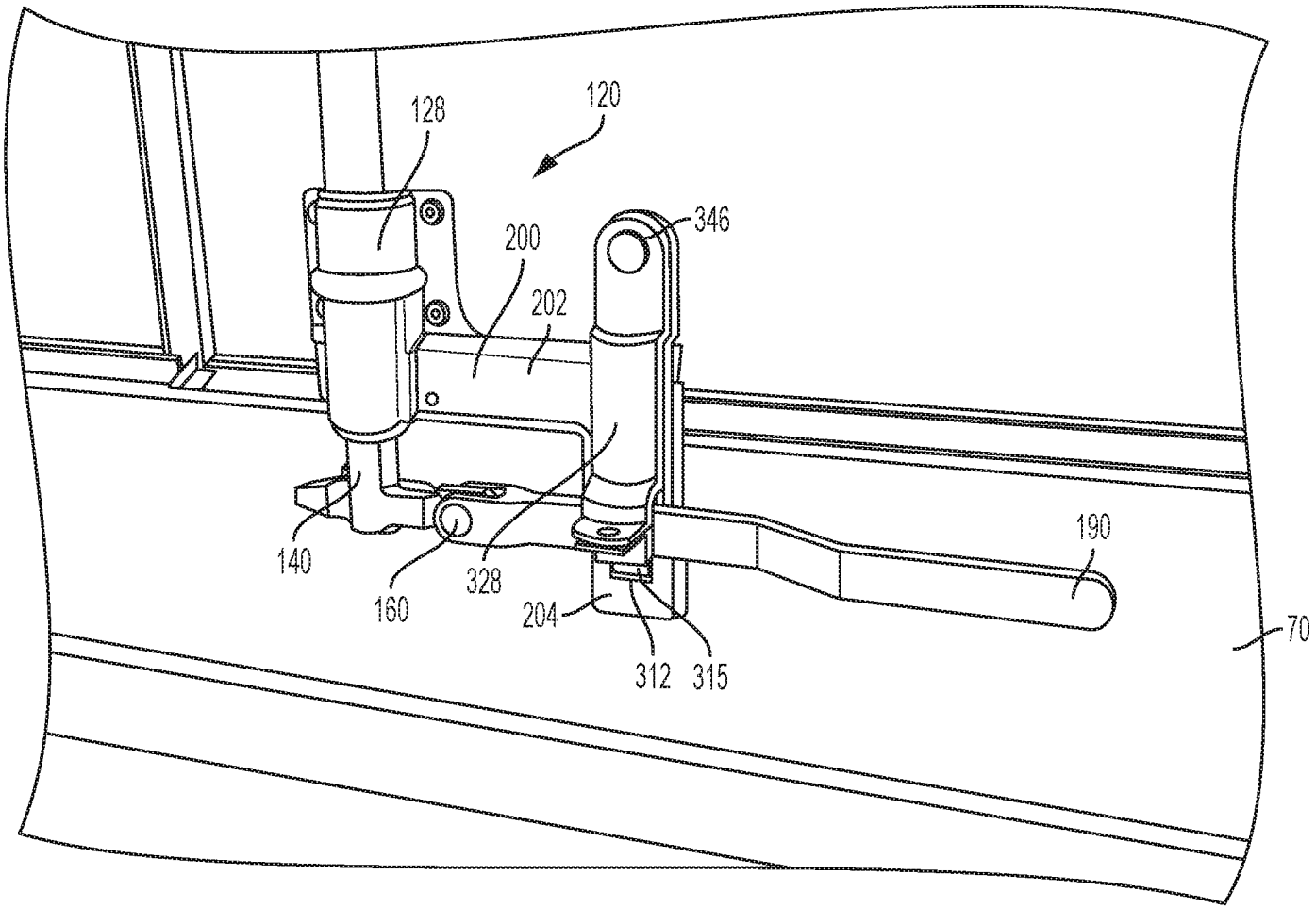
FIG. 11 is a perspective view of an alternative embodiment of the locking assembly of FIG. 4.

Referring to FIG. 4, locking assemblies 100 secure the doors in a closed position on rear frame 28 (FIG. 1) (so that the doors close the rear opening of the cargo space otherwise defined by the rear frame). In an embodiment, each locking assembly 100 comprises a generally cylindrical, hollow lock rod 104 that extends through, and pivots within, an upper bearing bracket 110, a middle bearing bracket 115, and a lower bearing bracket 120. Upper and lower bearing brackets 110, 120 may be manufactured by, for example metal casting or metal fabrication methods such as cutting and bending operations. For example, FIG. 5 illustrates a cast lower bracket 120, and FIG. 11 illustrates a metal fabricated lower bracket 120. Referring to FIG. 5, bearing bracket 120 includes flanges 122 that abut door 30 (FIG. 1) so that the bearing brackets attach at through-holes 124 (only two visible from the perspective shown in FIG. 5, but all four shown in FIG. 6) via attachment hardware (not shown), e.g. screws, rivets, etc. Bearing bracket 120 further includes a bearing retainer portion 128 that has a U-shaped cross-section and that holds a bearing, e.g. a plain bearing or roller bearing (not shown), within which lock rod 104 pivots about the lock rod's axis. Referring also to FIG. 6, a bearing 134 (see also an alternative embodiment of bearing 134 in FIG. 8) having an exterior cross section that matches interior cross sections (the interior defined as the portion of the bracket partially enclosing a volume between the bracket and the door) of bearing retainer portion 128 (FIG. 5), is disposed within bearing retainer portion 128 and held in place in the lock rod's axial direction via upper and lower bearing keeper ridges 130. Keeper ridges 130 are defined by upper and lower edges of a portion of bearing retainer portion 128 (FIG. 5) having an enlarged interior relative to horizontal cross sections above and below the enlarged interior. The enlarged interior portion is sized to receive a lower portion 136 of the housing of a bearing 134 that is enlarged, in the radial direction (considered with respect to the lock rod longitudinal axis), with respect to the upper part of the bearing housing, so that upper and lower surfaces of the enlarged lower bearing portion are retained in the axial direction (of the lock rod longitudinal axis) against upper and lower keeper ridges 130, respectively, thereby restricting vertical movement of bearing 134. Additionally, lower bracket 120 defines a flange 121 (FIG. 5) that extends radially outward from the main semi-cylindrical portion of retainer portion 128. The outermost portion of flange 121 is semi-annular in shape, thereby defining a corresponding semi-annular groove at the interior surface of retainer portion 128 that receives an upper flange 135 of the housing of bearing 134. In a further embodiment, bearing 134 is disposed entirely within an enlarged section of retainer portion 128, and top and bottom surfaces of the enlarged section act as bearing keeper ridges 130. In this way, bearing keeper ridges 130 are disposed above and below the top and bottom, respectively, of bearing 134 so that bearing 134 is retained between the bearing keeper ridges. Upper bearing brackets 110 and middle bearing brackets 115 have similar geometry to retain bearings.

Figure 7:
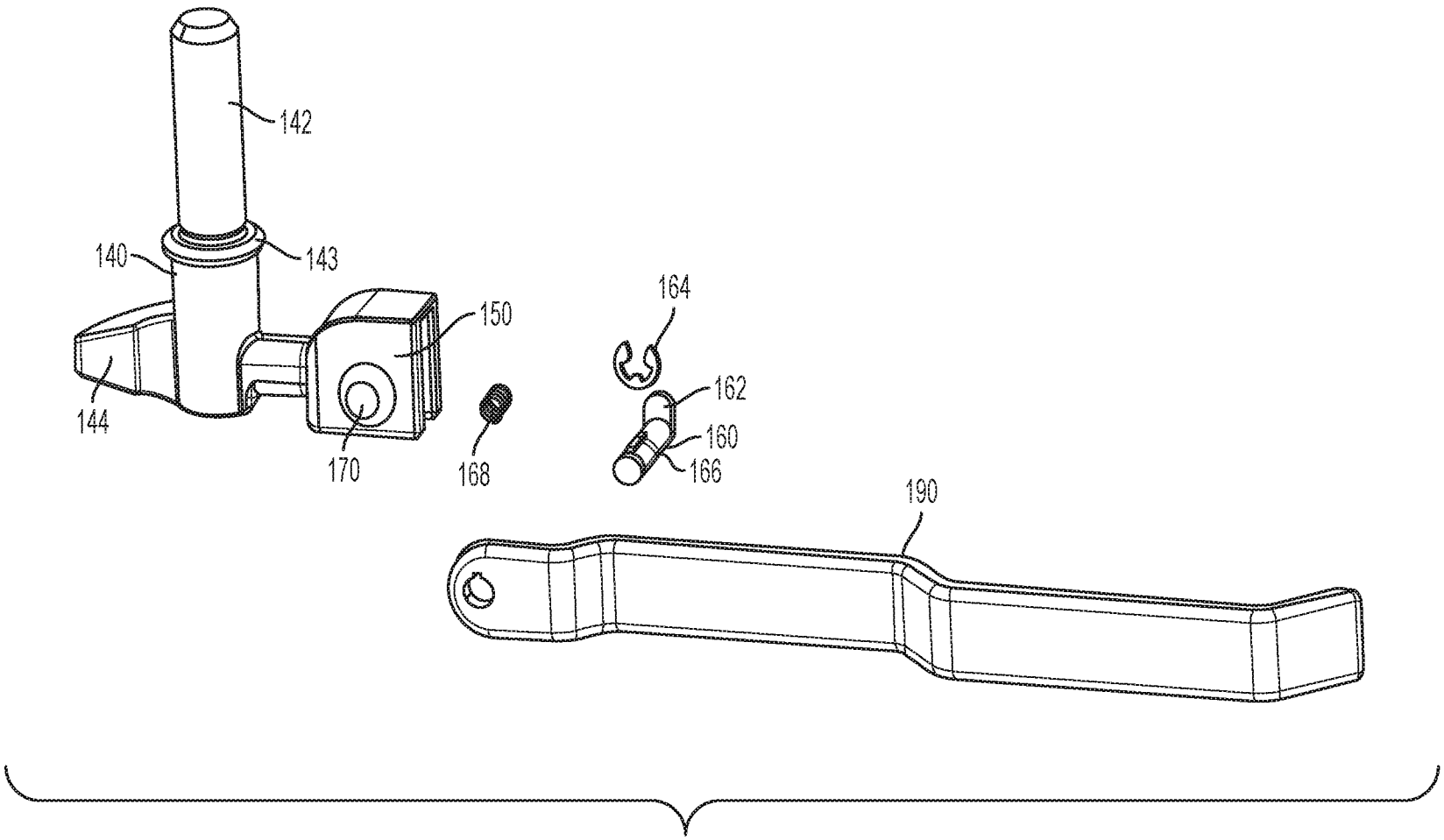
FIG. 7 is an exploded view of a portion of the locking assembly of FIG. 4.

Referring to FIGS. 5 and 7, a lower cam, or latch, 140 includes a cylindrical upper portion 142 that extends vertically from a lower portion of the lower cam portion from which a protuberance, or latch portion, 144 extends. Upper portion 142 extends into a bottom of lock rod 104, within its hollow cavity, and cam 140 is welded to lock rod 104. Latch portion 144 extends into, and engages a keeper, or retainer, 146 that is welded to rear sill 70 (FIG. 1). Latch portion 144 has a vertical planar face that abuts an opposing vertical planar face within keeper 146 that opposes rear sill 70 when the cam is in a locked position. Further, latch portion 144 has a curved side opposite the vertical planar face to prevent latch portion 144 from interfering with rear sill 70 as cam 140 pivots. Cam 140 is in a locked position when it is oriented so that latch portion 144 extends in a direction that is generally parallel with the direction of elongation of rear sill 70 and between rear sill 70 and the vertical planar face of keeper 146. The gasket, described above, that extends along the door biases against the rear frame so that the door is forced outward, thereby holding latch portion 144 against keeper 146 when the door is latched and thus removing any play between latch portion 144 and keeper 146. As shown in FIG. 4, a top cam 140' has a lower cylindrical portion that extends into lock rod 104 and attaches at the top of lock rod 104 via weldment, similar to lower cam 140, but in an opposite orientation. In further embodiments, such as, for example, dry freight trailers, the top, or header, of rear frame 28 is sufficiently thin, in order to limit the size of the lip depending downward from the inner surface of roof 16, that a full size keeper cannot fit on the header. Instead, a thinner keeper attaches to the header and engages with a correspondingly thinner top cam. Top cam 140' is configured to be pivoted within a keeper 146', attached to a top of rear frame 28 so that top cam 140' and bottom cam 140 simultaneously engage keepers 140' and 140, respectively. In this way, the doors are held closed. When top cam 140' and lower cam 140 are disengaged from keepers 146 and 146', respectively (that is, when corresponding latch portions are pivoted away from the opposing vertical planar face of the keepers and toward the trailer body so that the latch portions no longer extend into the keepers), the door is pivotable about its hinge. With the cams' latch portions rotated inward in such manner, the latch portions pass by the keepers as the door opens. Stated another way, when cam 140 is in a second orientation that is rotationally offset from the locked position, latch portion 144 disengages from, and extends away from, keeper 146 so that the door may be opened.

Bottom cam 140 has an annular ridge 143 extending outward from and around cylindrical upper portion 142 (FIG. 7) so that annular ridge 143 cannot fit through bottom bearing bracket 120. Similarly, top cam 140' has an annular ridge 143' around its cylindrical lower portion (not shown in detail) that extends sufficiently radially outward from an axis of elongation of the cylindrical lower portion such that it cannot fit through bracket 110. In this way, annular ridges 143 and 143' act as an upper and a lower stop, respectively, so that lock rod 104 cannot move vertically within the bearing brackets.

Referring to FIGS. 5 and 7, a handle attachment yoke 150 extends from a side of cam 140 opposite latch portion 144. Handle attachment yoke 150 includes two vertical parallel plates connected to each other on a top end and an end proximal the main portion of cam 140, leaving an opening between the bottom end and end distal from the main portion of cam 140, as shown in FIG. 7. A handle 190 is inserted into the opening of handle attachment yoke 150 and attaches thereto via a pivot pin 160. Pin 160 extends through a through-hole in one side of yoke 150, through a through-hole in an end of handle 190, and into a boss 170. In this way, handle 190 pivots with respect to cam 140 so that it may pivot around an axis of the pivot pin at least between a first position, wherein a distal end of handle 90 is at a greater height than the handle's pivot axis, to a second position at which handle 90 extends straight down, so that the distal end is directly below pivot pin 160. In a further embodiment illustrated in FIG. 11, handle 190 has a forked end that straddles a generally planar plate with a hole therethrough extending from cam 140 so that the through-hole in the planar portion of cam 140 aligns with corresponding through-holes in forked end 140, and pin 160 extends through the aligned holes to provide a pivot axis. In this embodiment, the distal end of handle 190 may rotate at least from directly above pin 160 to directly below pin 160. By attaching handle 190 directly to cam 140, which is at a vertical level below the door, at the rear sill, the handle is provided at a convenient height for enabling an operator to operate the locking assembly.

Handle 190 is elongated and generally planar in a vertical direction and is spaced sufficiently away from rear sill 70 (FIG. 1) so that when the handle is oriented so that latch portion 144 of cam 140 is within and engages keeper 146 (FIG. 5), the gap between the handle and the door can receive an operator's hand. In an embodiment, the distal end depends back towards the door, as shown in FIG. 5.

Figure 8:
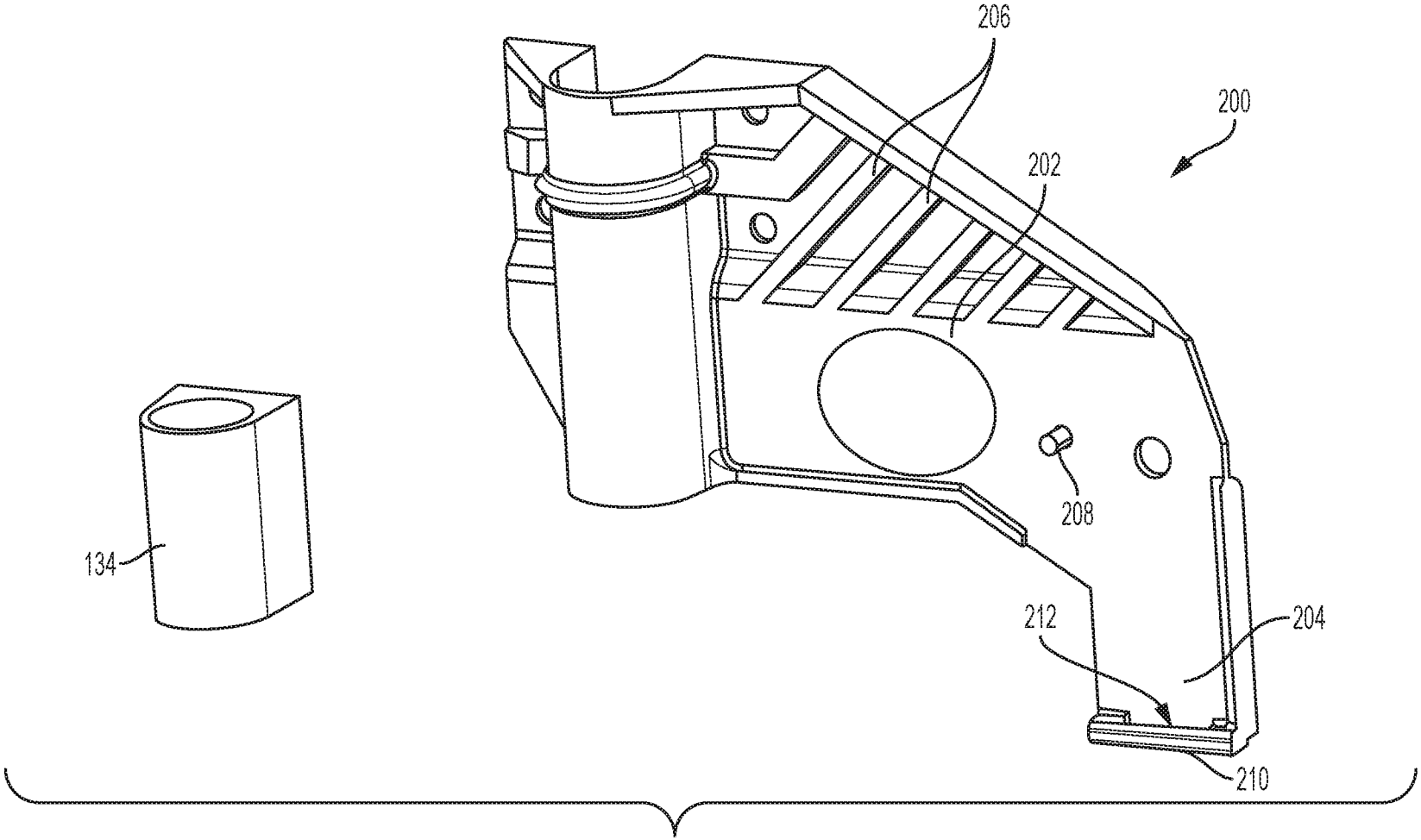
FIG. 8 is a perspective view of a bearing bracket and bearing for use in the locking assembly of FIG. 4.
Figure 9:
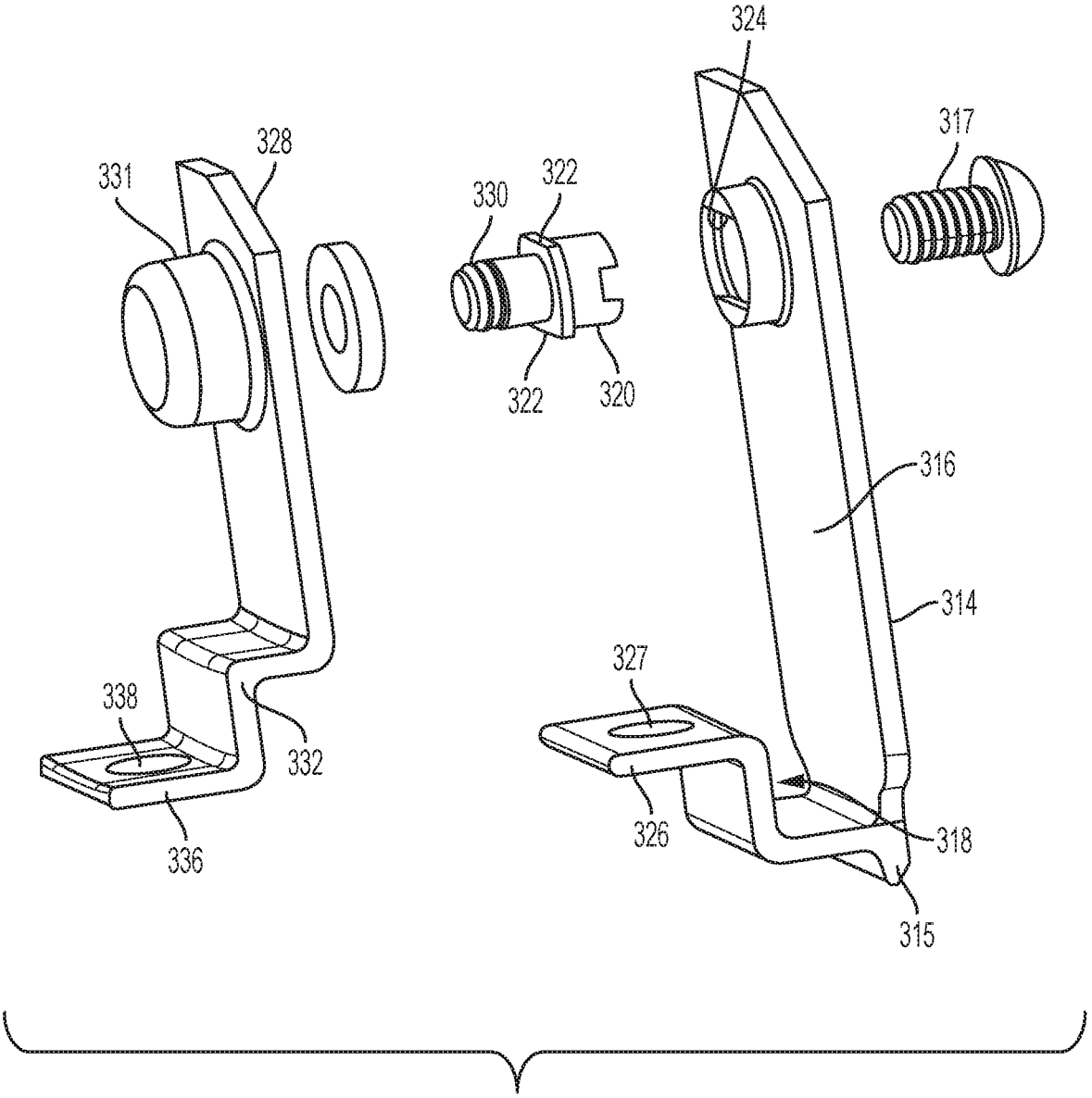
FIG. 9 is an exploded view of a latching assembly for the locking assembly of FIG. 4.

Referring to FIGS. 5, 8, and 9, right side lower bearing bracket 120 extends from lock rod 104 and towards the right side of the trailer to provide a latch mounting flange 200. Latch mounting flange 200 supports hardware, disclosed below, for locking handle 190 in place so that lock rod 104 cannot be pivoted about its axis to open the trailer. In the past, separate holes have been drilled into the door for attaching each component of a given latching assembly (attached at a position higher on the door than is illustrated in the present Figures). As shown in the illustrated embodiments, the mounting of the locking hardware to bearing bracket 120, rather than directly to the door, minimizes the required number of holes in the door to receive mounting hardware (e.g. screws and rivets). Mounting flange 200 is generally L-shaped, having a lateral (with respect to the lock rod axis) portion 202 with a major dimension in the horizontal direction, and extending from the lock rod and towards the side of the trailer, and a vertical portion 204 having a major dimension in the vertical direction, parallel with the lock rod axis and turning downward at a location laterally spaced from the lock rod's axis. A plurality of ribs 206 runs diagonally across the face of lateral portion 202, with a solid face behind the ribs. A ledge 210 extends away from the generally planar face of vertical portion 204 and from rear sill 70 (FIG. 1) at a bottom edge of flange 200 and vertical portion 204, and a slot 212 extends therethrough. A lower-most point of mounting flange 200 extends about 4.5 inches below rear sill 70.

A latch assembly includes a lower handle holding member 314 and an upper latch portion 328 that is pivotably attached with respect to lower handle holding member 314. Lower handle holding member 314 includes a planar vertical portion 316 that abuts lock mounting flange 200, and a bottom lip 315 depends downward and into a retainer to partially retain the handle holding member. In the illustrated embodiment the retainer is embodied as slot 212. The retainer attaches to the door, and in some embodiments, attaches to the door by integral formation with the door. A screw 317 extends through mounting flange 200, through an aperture in vertical portion 316 of lower handle holding portion 314, and into a nut 320. Nut 320 defines external flats 322 on an outer flange that mate with internal flats 324 in the aperture of holding member 314 so that nut 320 cannot rotate with respect to lower handle holding member 314. A lower portion of lower handle holding member 314 defines a U-shaped channel 318 that is configured to receive, and receives, a bottom portion of handle 190. Extending from an upper edge of U-shaped channel 318 opposite vertical portion 316 is a horizontal flange 326 defining an aperture 327 therethrough. The vertical position of horizontal flange 326 and its horizontal spacing from pin 160 (FIG. 7) and the handle's pivot axis is selected such that when handle 190 is pivoted about the pin axis up and away from channel 318 within the handle's range of motion permitted by yoke 150 (e.g. when the handle is lifted so that its distal end is raised to its maximum height), a lowermost edge of handle 190 is raised above the upper face of horizontal flange 326 so that the handle may be placed in and removed from channel 318 and pivoted around the lock rod's axis above horizontal flange 326.

Upper latch portion 328 pivotably attaches to male threads 330 extending from nut 320 via female threads in pivot cap 331. A pin 208 extends from a face of latch mounting flange 200 to prevent upper latch portion 328 from unscrewing from male threads 330. Upper latch portion 328 has a dogleg 332 that extends at a distal end so that an alignment of dogleg 332 with channel 318 creates a generally rectangular channel through which handle 190 may extend. A horizontal planar flange 336 extends from a bottom edge of dog leg 332, and an aperture 338 through horizontal planar portion 336 aligns with aperture 327 in horizontal flange 326 to receive the padlock's shackle. In this way, lock handle 190 may be securely received in the rectangular channel, thereby preventing lock rod 104 from pivoting and therefore disengaging cam 140 from keeper 146.

Upper latch portion 328 attaches to male threads 330 via internal female threads that are exposed only to a back side facing door 30. For example, the internal female threads may be embodied as a cap nut welded to a face of upper latch portion 328 so that an opening to the threads faces the door. In this embodiment, no fasteners are exposed when the door is locked, thereby preventing removal of upper latch portion 328 when the latch is shackled to lower handle holding member 14. In this way, undesired access to the semi-trailer is prevented.

Figure 10:
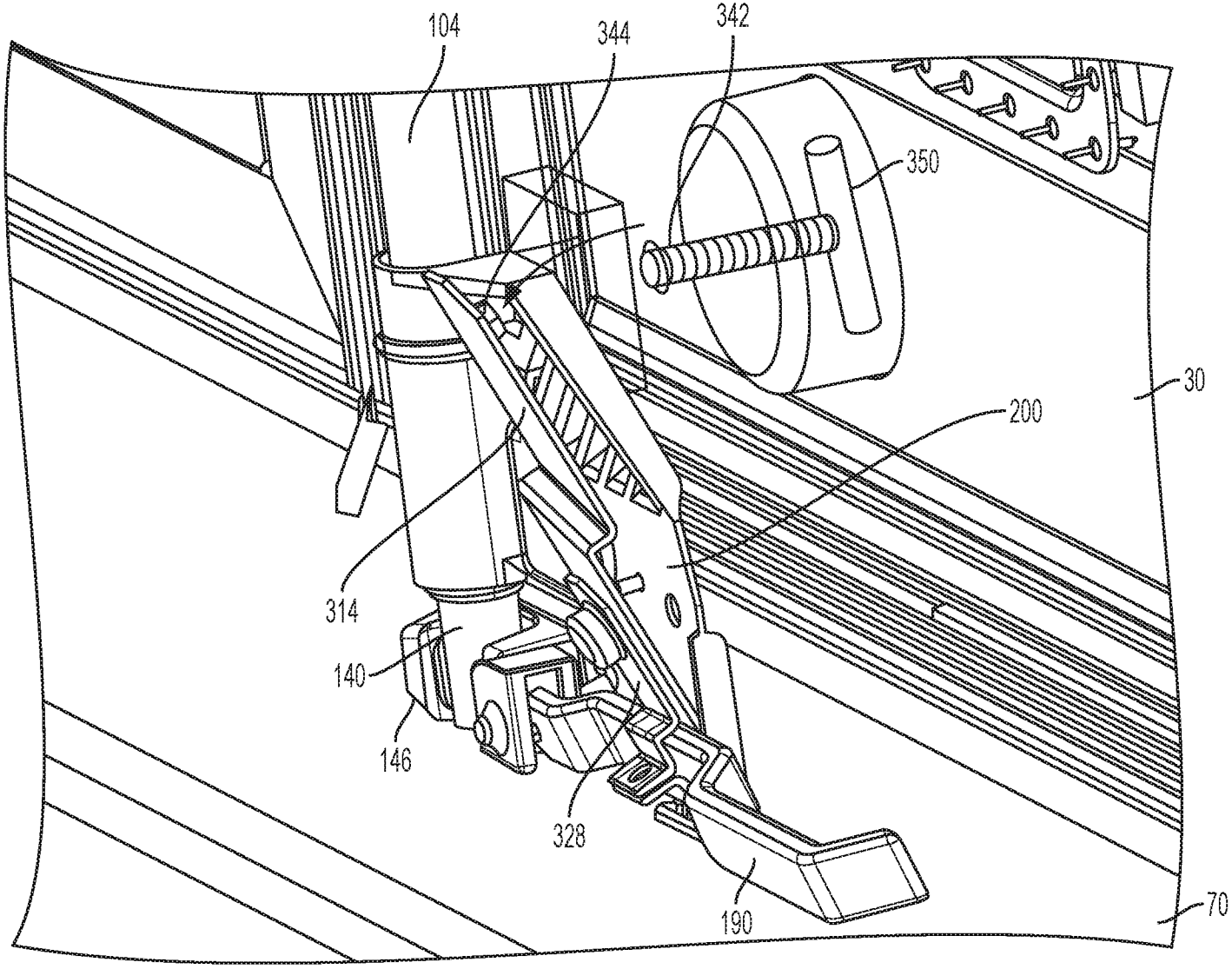
FIG. 10 is a perspective view of the latching assembly of FIG. 4 illustrating a safety release portion.
Figure 12:
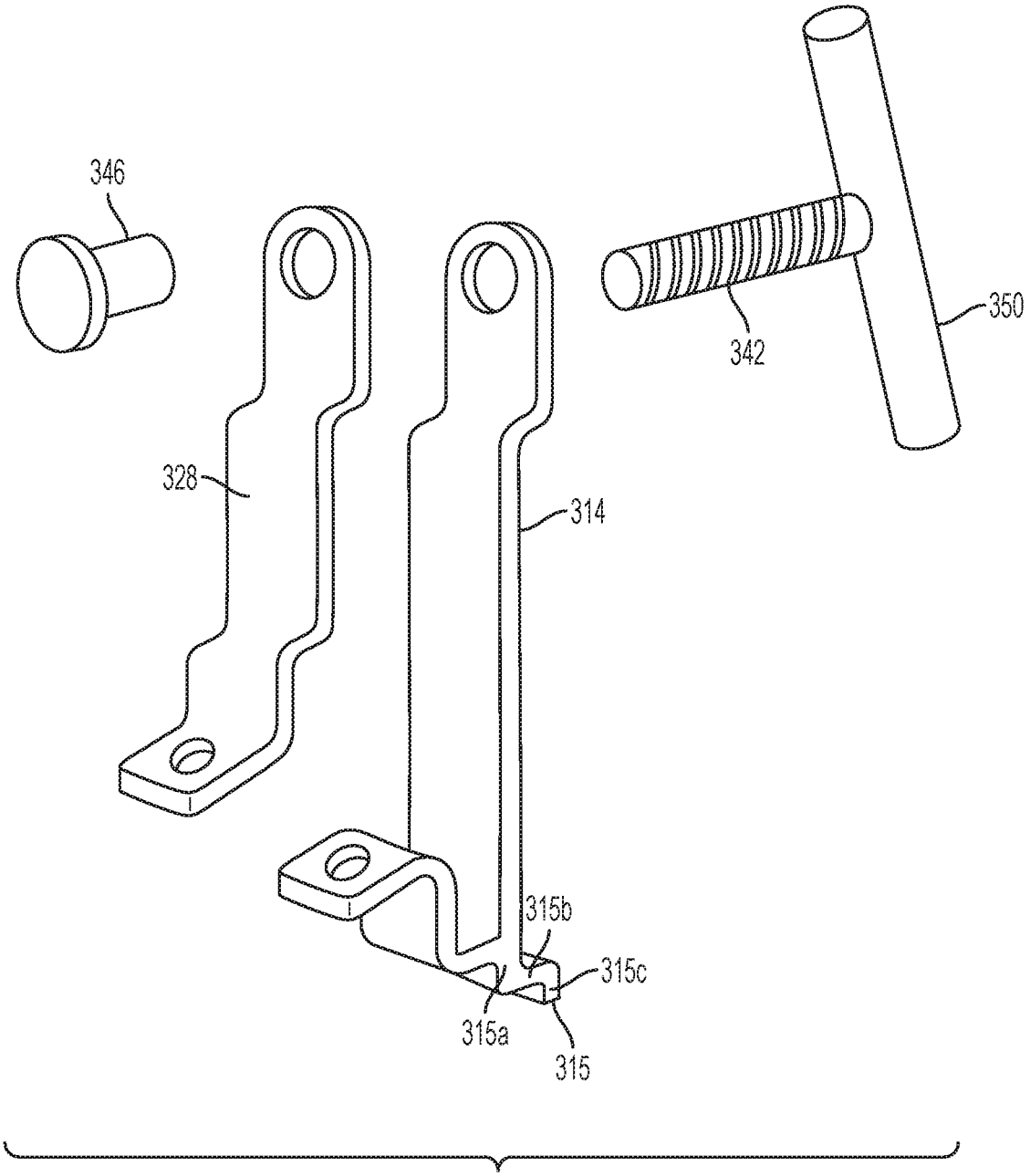
FIG. 12 is an exploded perspective view of a portion of the locking assembly of FIG. 11.

In further embodiments, examples of which are illustrated in FIGS. 10-12, the locking hardware is releasable from an interior of the semi-trailer, even when handle 190 is latched in the channel defined by upper latch portion 328 and lower handle holding member 314, so that cam 140 may be disengaged from keeper 146. Referring to an embodiment illustrated in FIG. 10, unlike the embodiment of FIGS. 8-9, lower handle holding member 314 does not attach to flange 200 via the screw (317, FIG. 9) that, in the FIG. 9 embodiment, extends through flange 200, lower handle holding member 314, and into the female threads of upper latch portion 328. Rather, the upper end of the holding member 314 extends above flange 200 and defines female threads in a door-facing nut 344 that may be attached to or formed integrally with the door-facing surface holding member 314. The female threads of nut 344, like the female threads in upper latch portion 328, are exposed only to a back side, facing door 30. A threaded rod 342 threadedly attaches to lower handle holding member 314 in the female threads of nut 344. Threaded rod 342 extends through the trailer door and attaches to a handle 350 inside the semi-trailer's interior. An interior nut (not shown) threads onto threaded rod 342 and biases against an inside surface of the door and opposes nut 344, which biases against an outside surface of the door, thereby preventing travel of threaded rod 342 in its axial direction. In assembly, threaded rod 342 is tightened down into nut 344, and the interior nut is subsequently backed down the threads of threaded rod 342 in the direction of nut 344 and tightened against the inside surface of the door so that a face of each of nut 344 and the interior nut biases against its respective side of the door. Threaded rod 342 may be unscrewed from the threads in nut 344 via handle 350. When threaded rod 342 is unscrewed from nut 344, lower handle holding member 314 and upper latch portion 328 connect to the semi-trailer only at slot 212. Pressure applied to door 30 from the semi-trailer's interior causes lower handle holding member 314 and upper latch portion 328 to pivot (as indicated by the arrow in FIG. 10) so that bottom lip 315 of lower handle holding member 314 falls out of slot 212 (FIG. 8), thereby allowing handle 190 to pivot about lock rod 104's axis and release the door. Handle 190, with latch 314/328, now no longer supported by the latch, rotates downward about pin 160 (FIG. 7) in response to gravity. If a person in the cargo aria continues to push the door outward, the engagement between latch portion 144 and keeper 146 (FIG. 4) causes the lock rod to rotate until the latch portion eventually slides past the keeper and the door opens.

FIGS. 11 and 12 illustrate another embodiment, wherein the locking hardware is releasable from the interior of the trailer. This releasable embodiment is included on the right side, or curbside, door only. In the illustrated embodiment, vertical flange 204 defines a slot 312. Bottom lip 315 of lower handle holding member 314 includes a z-shaped profile including a first portion 315*a* that extends downward from lower handle holding member 314, a second portion 315*b* that extends back towards the rear frame, and a third portion 315*c* that extends downwards from a forwardmost edge of second portion 315*b*. Like the embodiment shown in FIG. 10, an interior nut is threaded onto threaded rod 342 and biases against an inside surface of the door. Threaded rod 342 extends through the trailer door (not shown) and into female threads defined by the interior bore of a rivet nut 346. Rivet nut 346 is press-fit into the through-hole in lower latch portion 314 so that rivet nut 346 cannot rotate with respect to lower latch portion 314. However, rivet nut 346 has sufficient clearance within the inner diameter of the through-hole in upper latch portion 328 in order to allow upper latch portion 328 to pivot with respect to lower latch portion 314 about an exterior surface of rivet nut 346. In this way, upper latch portion 328 pivots about the axis of threaded rod 342. A trailer operator may rotate upper latch portion 328 about the axis to allow access to the lower arm. Lower handle holding member 314 is affixed in this way to door 30 (FIG. 10), as it is held by rivet nut 346 and against door 30, and cannot pivot about the axis of threaded rod 342, as the bottom lip 315 is kept within slot 312. Upper latch portion 328 is of sufficient length in its radial direction from its axis of pivot about threaded rod 342 so that it cannot pivot 360 degrees about its axis of pivot; a distal end of upper latch portion 328 extends to bearing retainer portion 128, which restricts further rotation.

Referring to FIG. 7, in an embodiment, pin 160 includes a latch 162 that extends from an end of the pin that faces the door when cam 140 is oriented so that it engages keeper 146 (FIG. 5). Latch 162 extends in a radial direction with respect to pin 160's axis and in a direction perpendicular to the direction of the handle 190's elongation. Pin 160 includes a key on its upper surface that extends axially (with respect to the pin's axis) therealong and that is received in a slot at a circumference of the through-hole that extends through an end of handle 190 that receives pin 160 so that rotation of handle 190 causes corresponding rotation of pin 160. A spring 168 is disposed in handle attachment yoke 150 within boss 170 and biases pin 160 away from boss 170. An external retaining C-clip 164 is disposed in a corresponding groove 166 about the circumference of pin 160 between the parallel plates of yoke 150 and on the side of handle 190 opposite boss 170. In this way, pin 160 is kept within yoke 150, and spring 168 is maintained under compression. When assembled, a handle assembly includes, in order of components encountered from boss 170 in the pin's axial direction, spring 168, pin 160, handle 190, and retaining ring 164. Spring 168 applies a force to cause friction between rotating components (e.g. forcing a face of C-clip 164 against an inside face of yoke 150, thereby holding the handle in place unless an operator applies a force to cause it to rotate about the axis of pin 160. In other embodiments, spring 168 is omitted.

Figure 13:
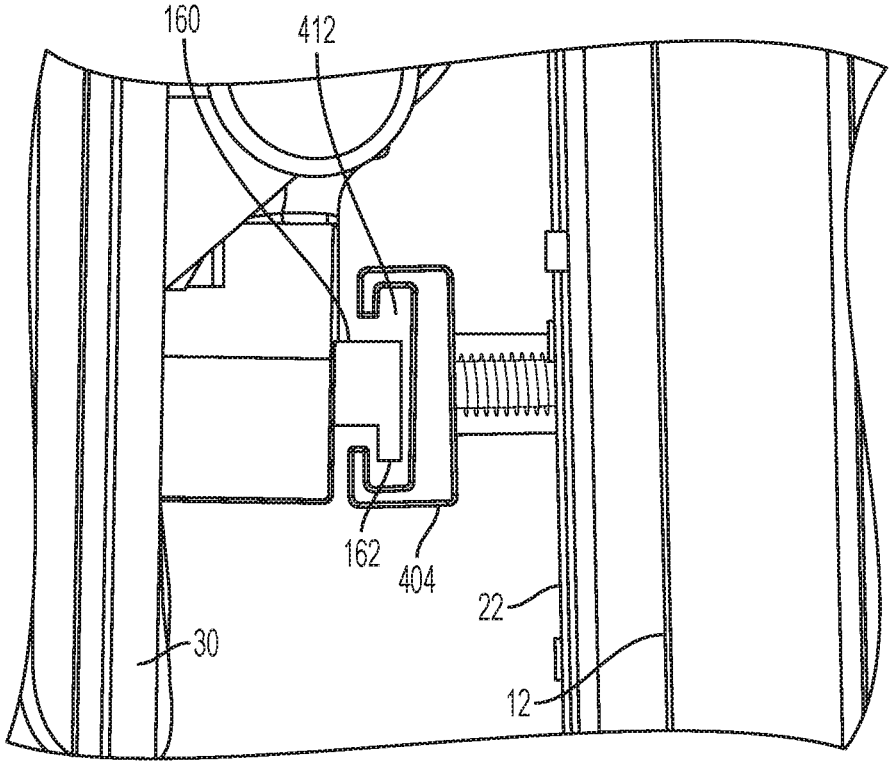
FIG. 13 is a partial top view of the locking assembly of FIG. 4 that is in a configuration for holding a door open.
Figure 14:
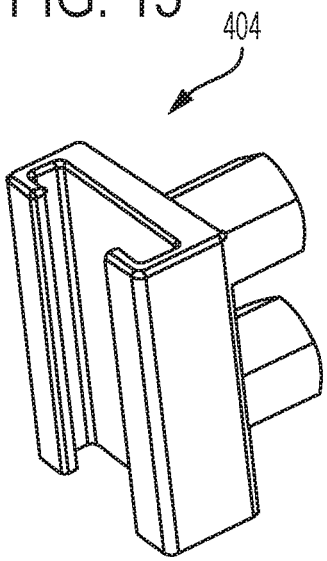
FIG. 14 is a perspective view of a keeper for holding the door open as illustrated in FIG. 13.
Figure 15:
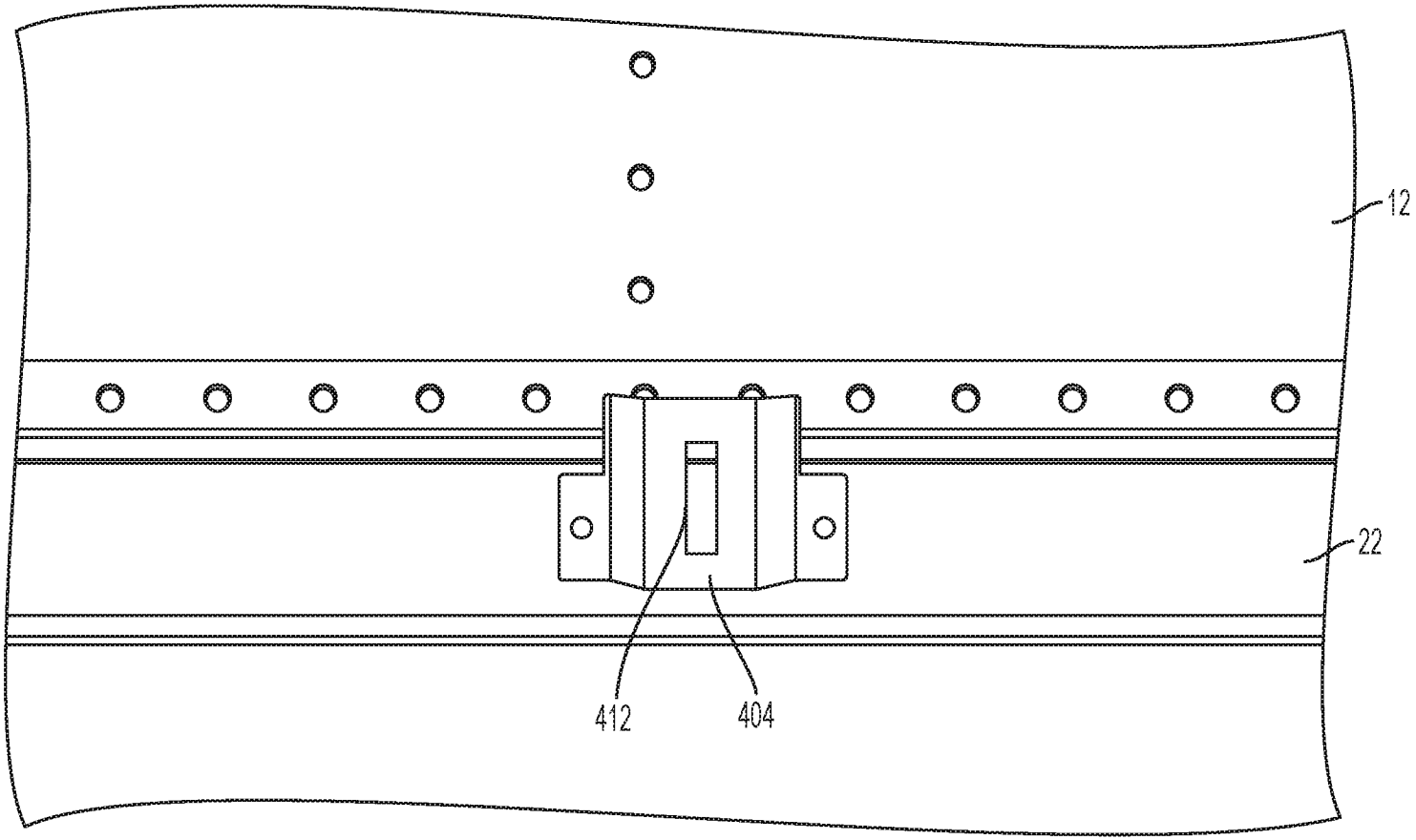
FIG. 15 is a perspective view of an alternative to the keeper of FIG. 14.

Referring to FIGS. 13-14, latch 162 of pin 160 extends from the proximal end of handle 190 so that doors 30 may be held in an open position. A keeper 404 attaches to side rail 22 (see also FIG. 1) to hold door 30 open and generally adjacent side wall 12 when the operator swings the door 270° from its closed position at the trailer rear and around to the trailer side. In an embodiment, keeper 404 is a vertically-oriented channel having a "C" shaped cross-section, and a longitudinal opening, herein also referred to as slot 412, into the channel that faces away from the side rail. A pair of vertically-spaced female-threaded standoffs attaches to the keeper opposite the longitudinal opening and receive screws that extend through through-holes in side rail 22 to hold keeper 404 to side rail 22. In a further embodiment, shown in FIG. 15, keeper 404 is fabricated from sheet metal and has a "hat" shape cross section with a vertically planar portion parallel to the side rail's face that is spaced away from the side rail by a pair of spacing portions and attaches to the side rails by attachment flanges through apertures in the flanges via rivets. A vertically elongated slot 412 extends through the vertical planar portion.

Referring to FIG. 13, keeper 404 attaches to the bottom rail in a location to receive latch 162 when the door is opened and the generally planar outer door surface is generally parallel to or slightly pivoted (about the door hinge axis) toward the generally planar trailer side wall, so that latch 162 extends in its longest dimension in a direction so that it is aligned with the direction of elongation of slot 412. That is, latch 162 extends into keeper 404 so that, when in a first orientation, when handle 190 (FIGS. 4 and 7) is horizontal, latch 162's longest dimension is aligned vertically so that latch 162 fits through slot 412 in keeper 404 as the door reaches the side wall. When latch 162 is inserted through and past an interior face of the vertically planar portion, the handle may be turned downwards so that the handle's elongation direction is vertical and so that latch 162 is in a second orientation, with its long dimension extending in a direction perpendicular to slot 412's direction of elongation and horizontally with respect to the ground. In this second orientation, latch 162 cannot be removed from the channel, thereby holding the latch within keeper 404 and therefore the door in an open position. Because the door is held in the open position via keeper 404 when the handle is aligned downward, gravity holds the handle in place, and an operator needs to lift the handle back into its horizontal orientation in order to disengage latch 162 from keeper 404. In an embodiment, when the door is held open by latch 162 and keeper 404, the spacing between sidewall 12 and door 30 is about 3.5 inches or less.

Because certain trailers, most often refrigerated trailers, or "reefers," have floor foam for floor insulation, the handle of the door must be shifted vertically upward to prevent interference with the floor. By using a vertically-oriented channel or slot, one single keeper design may be used for multiple handle heights with respect to the side rail.

Referring to FIG. 2, because handle 190 (FIG. 5) attaches below the lower edge of door 30 (FIG. 1), when door 30 (FIG. 1) is opened, handle 190 extends from door 30 into a recessed lower portion 22*a* of side rail 22. Recessed portion 22*a* is recessed in that its outermost edge is relatively closer to the middle of the trailer than an outermost edge of a portion 22*b* above it. In this way, door 30 may be held closer to side wall 12 than if handle 190 attached at a height above recessed portion 22*a* of side rail 22, thereby reducing the overall width of the trailer when the doors are opened. Further, because the doors in this embodiment do not require bumpers to bias the doors outwards to keep tension on chains, the doors are held closely to the sides of the trailer.

While one or more preferred embodiments of the invention are described above, it should be appreciated by those skilled in the art that various modifications and variations can be made in the present invention without departing from the scope and spirit thereof. Accordingly, it should be understood that the elements of one embodiment may be combined with another embodiment to create a still further embodiment. It is intended that the present invention cover such modifications and variations as come within the scope and spirit of the present disclosure, the appended claims, and their equivalents. For example, while the disclosure is directed to use with a door assembly for a semi-trailer, an embodiment may be adapted for use with a storage container.

What is claimed is:

1. A locking assembly for a semi-trailer having two opposing elongated side walls, a floor extending between respective lower ends of the two opposing elongated side walls, a roof extending between respective upper ends of the two opposing elongated side walls, a front wall extending between respective forward ends of the two opposing elongated side walls and between respective forward ends of the floor and the roof, a rear frame non-movably attached to respective rearward ends of the two opposing elongated side walls, a rearward end of the roof, and a rearward end of the floor, and a pair of doors attached to the rear frame, wherein the two opposing elongated side walls, the floor, the roof, and the front wall define an interior of the semi-trailer, and wherein a first door of the pair of doors is pivotally attached at an edge of the first door to a vertical portion of the rear frame at one of the two opposing elongated side walls and a second door of the pair of doors is pivotally attached at an edge of the second door to a vertical portion of the rear frame at the other of the two opposing elongated side walls, the locking assembly comprising:

an elongated lock rod having an axis of elongation;

at least one bracket attached to the first door and extending about the lock rod so that the lock rod is retained proximate the first door in a vertical orientation and so that the lock rod is rotatable about the axis of elongation;

a first keeper attached to the rear frame of the semi-trailer;

a first latch member attached to the lock rod so that the first latch member rotates with the lock rod, wherein in a first rotational position of the lock rod when the first door is in a closed position on the rear frame at which the first door closes an opening to the interior, the first latch member engages the first keeper so that the lock rod retains the first door in the closed position, and wherein in a second rotational position of the lock rod rotationally offset from the first rotational position, the first latch member disengages from the first keeper so that the first door is pivotable from the closed position;

a second latch member attached to the lock rod so that rotation of the second latch member about the axis of elongation rotates the lock rod about the axis of elongation; and a second keeper that is attached to the first door by a handle that extends through the first door into the interior, wherein, when the second keeper is retained to the first door by the handle and a portion of the second keeper extends into a retainer attached to the first door, the second latch member is receivable by the second keeper so that the second keeper retains the second latch member adjacent to the first door, wherein the second latch member is connected to the lock rod at a position so that when the second latch member is received by the second keeper, the lock rod is in the first rotational position, and wherein the handle is attached to the second keeper at a connection that is releasable by actuation of the handle from within the interior when the first door is in the closed position, thereby releasing the second keeper from the handle so that the portion of the second keeper is releasable from the retainer in response to movement of the first door by a force applied from the interior by a pivoting of the second keeper about an engagement between the portion of the second keeper and the retainer.

2. The locking assembly as in claim 1, wherein the second latch member has a first end pivotally attached to the lock rod about a horizontal axis so that the second latch member is pivotable with respect to the lock rod in a vertical direction.

3. The locking assembly as in claim 2, wherein the retainer is defined by an opening in the at least one bracket.

4. The locking assembly as in claim 3, wherein the second keeper comprises a lower portion that forms a U-shaped channel and an upper portion that is pivotable with respect to the lower portion between a first orientation that encircles the second latch member when the second latch member is received within a channel defined by the U-shaped channel and the upper portion, and a second orientation, wherein the upper portion extends away from the second latch member so that the second latch member is removable from the U-shaped channel.

5. The locking assembly as in claim 1, wherein the handle comprises a threaded rod that extends from the interior of the semi-trailer, through the first door, and into female threads defined by the second keeper.

6. The locking assembly as in claim 5, wherein the threaded rod extends from the interior of the semi-trailer, through the first door, through the at least one bracket, and into the female threads defined by the second keeper.

7. The locking assembly as in claim 5, wherein the female threads are accessible only from a side of the second keeper that faces the first door.

8. The locking assembly as in claim 1, wherein a portion of the second keeper is pivotable about a second axis that is perpendicular to a face of the first door.

9. The locking assembly as in claim 8, wherein the portion of the second keeper is pivotable about a threaded coupling.

10. The locking assembly as in claim 9, wherein the handle comprises a threaded rod, the portion of the second keeper defines female threads therein, and the threaded coupling is defined by a threaded engagement between the threaded rod and the second keeper.

11. The locking assembly as in claim 1, wherein the second keeper further comprises a first aperture, and wherein, when the second keeper is in a locked position, the first aperture is aligned with a second aperture in a protrusion that is attached to the first door so that both the first and second apertures are configured to simultaneously receive a lock hasp in order to hold the second keeper in place with respect to the protrusion and thereby hold the second latch member by the second keeper proximate the first door.

12. The locking assembly as in claim 1, wherein the second latch member is attached to the lock rod by an attachment of the second latch member to the first latch member.

13. The locking assembly as in claim 1, wherein the second latch member is disposed below a lower edge of the first door.

14. A locking assembly for a semi-trailer having two opposing elongated side walls, a floor extending between respective lower ends of the two opposing elongated side walls, a roof extending between respective upper ends of the two opposing elongated side walls, a front wall extending between respective forward ends of the two opposing elongated side walls and between respective forward ends of the floor and the roof, a rear frame non-movably attached to respective rearward ends of the two opposing elongated side walls, a rearward end of the roof, and a rearward end of the floor, and a pair of doors attached to the rear frame, wherein the two opposing elongated side walls, the floor, the roof, and the front wall define an interior of the semi-trailer, and wherein a first door of the pair of doors is pivotally attached at an edge of the first door to a vertical portion of the rear frame at one of the two opposing elongated side walls and a second door of the pair of doors is pivotally attached at an edge of the second door to a vertical portion of the rear frame at the other of the two opposing elongated side walls, the locking assembly comprising:

an elongated lock rod having an axis of elongation;

at least one bracket attached to the first door and extending about the lock rod so that the lock rod is retained proximate the first door in a vertical orientation and so that the lock rod is rotatable about the axis of elongation;

a first keeper attached to the rear frame of the semi-trailer;

a first latch member attached to the lock rod so that the first latch member rotates with the lock rod, wherein in a first rotational position of the lock rod when the first door is in a closed position on the rear frame at which the first door closes an opening to the interior, the first latch member engages the first keeper so that the lock rod retains the first door in the closed position, and wherein in a second rotational position of the lock rod rotationally offset from the first rotational position, the first latch member disengages from the first keeper so that the first door is pivotable from the closed position to an open position in which the first door is adjacent an outer surface of one of the two opposing elongated side walls;

a handle attached to the lock rod so that rotation of the handle about the axis of elongation rotates the lock rod about the axis of elongation, wherein the handle has a first end pivotally attached to the lock rod about a horizontal axis so that the handle is pivotable with respect to the lock rod in a vertical direction;

a second latch member attached to the handle at the horizontal axis so that the second latch member rotates with the handle and about the horizontal axis; and a second keeper disposed at an elongated bottom rail that extends between the front wall and the rear frame and to which the one side wall and the floor attach, wherein the second keeper is disposed on the bottom rail so that the second keeper receives the second latch member when the handle is disposed at a first rotational position about the horizontal axis and that retains the second latch member, and therefore retains the first door adjacent the one side wall, when the handle is disposed at a second rotational position about the horizontal axis.

15. The locking assembly as in claim 14, wherein the first door is spaced less than about 3.5 inches from a respective side wall of the two opposing elongated side walls when the second latch member is retained by the second keeper.

16. The locking assembly as in claim 14, wherein the second keeper is attached to a lower, recessed portion of the bottom rail of the semi-trailer.

17. The locking assembly as in claim 14, wherein the second latch member extends in a direction perpendicular to a direction of elongation of the handle.

18. The locking assembly as in claim 17, wherein the second keeper comprises an elongated vertical slot through which the second latch member extends when the second latch member is aligned with the vertical slot so that the second keeper extends in the direction of elongation of the slot.

19. The locking assembly as in claim 14, wherein the second keeper comprises a channel having a C-shaped profile.

20. A locking assembly for a semi-trailer having two opposing elongated side walls, a floor extending between respective lower ends of the two opposing elongated side walls, a roof extending between respective upper ends of the two opposing elongated side walls, a front wall extending between respective forward ends of the two opposing elongated side walls and between respective forward ends of the floor and the roof, a rear frame non-movably attached to respective rearward ends of the two opposing elongated side walls, a rearward end of the roof, and a rearward end of the floor, and a pair of doors attached to the rear frame, wherein the two opposing elongated side walls, the floor, the roof, and the front wall define an interior of the semi-trailer, and wherein a first door of the pair of doors is pivotally attached at an edge of the first door to a vertical portion of the rear frame at one of the two opposing elongated side walls and a second door of the pair of doors is pivotally attached at an edge of the second door to a vertical portion of the rear frame at the other of the two opposing elongated side walls, the locking assembly comprising:

an elongated lock rod having an axis of elongation;

at least one bracket attached to the first door and extending about the lock rod so that the lock rod is retained proximate the first door in a vertical orientation and so that the lock rod is rotatable about the axis of elongation;

a first keeper attached to the rear frame of the semi-trailer;

a first latch member attached to the lock rod so that the first latch member rotates with the lock rod, wherein in a first rotational position of the lock rod when the first door is in a closed position on the rear frame at which the first door closes an opening to the interior, the first latch member engages the first keeper so that the lock rod retains the first door in the closed position, and wherein in a second rotational position of the lock rod rotationally offset from the first rotational position, the first latch member disengages from the first keeper so that the first door is pivotable from the closed position;

a second latch member attached to the lock rod so that rotation of the second latch member about the axis of elongation rotates the lock rod about the axis of elongation; and a second keeper attached to the first door by an attachment of the second keeper to the at least one bracket, wherein the second latch member is receivable into the second keeper so that the second keeper retains the second latch member adjacent to the first door, and wherein the second latch member is connected to the lock rod at a position so that when the second latch member is received by the second keeper, the lock rod is in the first rotational position.

21. The locking assembly as in claim 20, wherein the at least one bracket comprises at least one rib to increase the rigidity of the at least one bracket.

* * * * *